US012319465B2

(12) United States Patent
Derks

(10) Patent No.: US 12,319,465 B2
(45) Date of Patent: Jun. 3, 2025

(54) PACKAGING TRAY WITH A PROFILED SEALING EDGE

(71) Applicant: silver plastics GmbH & Co. KG, Troisdorf (DE)

(72) Inventor: Rene Derks, Belfeld (NL)

(73) Assignee: SILVER PLASTICS GMBH, Troisdorf (DE)

( * ) Notice: Subject to any disclaimer, the term of this patent is extended or adjusted under 35 U.S.C. 154(b) by 302 days.

(21) Appl. No.: 16/925,385

(22) Filed: Jul. 10, 2020

(65) Prior Publication Data

US 2021/0002018 A1 Jan. 7, 2021

(30) Foreign Application Priority Data

Jun. 4, 2019 (EP) ..... 19178257

(51) Int. Cl.
*B65D 1/40* (2006.01)
*B65D 1/34* (2006.01)
*B65D 77/20* (2006.01)

(52) U.S. Cl.
CPC ..... *B65D 1/40* (2013.01); *B65D 1/34* (2013.01); *B65D 77/2024* (2013.01); *B65D 2577/2066* (2013.01)

(58) Field of Classification Search
CPC .... B65D 1/40; B65D 1/34; B65D 2577/2066; B65D 77/2024; B29C 66/53461; B29C 66/7316; B29C 66/7361; B29C 66/81427
USPC ..... 229/246, 245; 220/239.1, 260
See application file for complete search history.

(56) References Cited

U.S. PATENT DOCUMENTS 3,192,091 A * 6/1965 Hey ..... B29C 66/24244 229/123.1
3,547,338 A * 12/1970 Hemmes ..... B32B 27/00 229/123.1
4,427,148 A * 1/1984 Seiter ..... B65D 77/2024 229/123.1
4,589,568 A * 5/1986 Ito ..... B29C 66/723 220/359.3
4,605,142 A * 8/1986 Itoh ..... B65D 77/2036 229/123.1
4,659,405 A * 4/1987 Walter ..... B29C 66/30223 425/395

(Continued)

FOREIGN PATENT DOCUMENTS

CN 104271464 A * 1/2015 ..... B65D 1/36
DE 202018106618 U1 * 1/2019

(Continued)

*Primary Examiner* — Robert F Long
*Assistant Examiner* — Eduardo R Ferrero
(74) *Attorney, Agent, or Firm* — Michael R. Shevlin

(57) ABSTRACT

The invention relates to a packaging tray (1), produced from a thermoformed plastics sheet, with a base (10), sidewalls (11, 12) and a sealing edge (13) which is formed peripherally on the upper side of the sidewalls (11, 12) and onto which a sealing film (2) can be placed and can be bonded to the sealing edge (13), in which the sealing edge (13) is formed with a contact surface, which is provided for supporting the sealing film, with a profiling in the form of projections (133) in each case forming part of the contact surface and with depressions (134) which run between adjacent projections (133) and interrupt the contact surface, wherein the depressions (134) in each case define a receiving volume.

5 Claims, 1 Drawing Sheet

(56) References Cited

U.S. PATENT DOCUMENTS 4,693,391 A * 9/1987 Roth ..... B65D 77/2036 220/359.4
4,834,247 A * 5/1989 Oshima ..... B65D 75/12 220/360
4,849,606 A * 7/1989 Martens, III ..... B65D 77/2024 239/34
4,865,217 A * 9/1989 Yoshimoto ..... B32B 27/34 229/123.1
4,905,838 A * 3/1990 Suzuki ..... B29C 66/71 229/123.1
4,913,307 A * 4/1990 Takata ..... B29C 66/232 220/276
4,961,513 A * 10/1990 Gossedge ..... B29C 65/18 220/276
5,118,002 A * 6/1992 Sugiyama ..... B29C 66/723 220/276
5,141,126 A * 8/1992 Takata ..... B65D 77/2056 220/359.3
5,157,901 A * 10/1992 Okamoto ..... B65B 7/2878 156/69
5,160,391 A * 11/1992 Thomas, Jr. ..... B65B 51/14 53/485
5,163,269 A * 11/1992 Williams ..... B65D 77/2024 53/412
5,167,339 A * 12/1992 Takata ..... B32B 27/08 229/123.1
5,176,314 A * 1/1993 Akazawa ..... B29C 66/81427 229/123.1
5,704,468 A * 1/1998 Lust ..... B65D 1/34 206/205
6,091,054 A * 7/2000 Mihalov ..... B29C 66/81431 53/477
6,460,720 B1 * 10/2002 Massey ..... B29C 66/131 220/802
6,499,595 B1 * 12/2002 Petricca ..... B65D 1/40 53/412
6,857,561 B2 * 2/2005 Williams ..... B65D 77/2044 229/123.1
9,023,411 B2 * 5/2015 Maatta ..... B65D 77/2024 426/106
10,279,987 B2 * 5/2019 Parrinello ..... B29D 22/003
10,399,759 B2 * 9/2019 Vinet ..... B32B 7/12
11,312,559 B2 * 4/2022 Derks ..... B65D 25/02
11,413,796 B2 * 8/2022 Pucci ..... B29C 66/112
2002/0074091 A1 * 6/2002 Faherty ..... B29C 65/305 156/583.1
2002/0108955 A1 * 8/2002 Erb ..... B65D 77/2024 220/359.4
2003/0152679 A1 * 8/2003 Garwood ..... B65D 81/264 426/392
2003/0183540 A1 * 10/2003 Onishi ..... B65D 43/168 206/205
2005/0252600 A1 * 11/2005 van Driesten ..... B32B 27/10 156/247
2006/0124652 A1 * 6/2006 Ohtsuki ..... B29C 66/80 53/485
2007/0082151 A1 * 4/2007 Hatano ..... B29C 66/71 428/35.7
2007/0290027 A1 * 12/2007 Maatta ..... B65D 77/2024 229/123.1
2009/0250466 A1 * 10/2009 Fujimura ..... B29C 66/81465 220/359.1
2010/0258471 A1 * 10/2010 Enriquez ..... B65D 1/34 220/608
2010/0276478 A1 * 11/2010 Gartz ..... B65D 43/162 229/247
2011/0086141 A1 * 4/2011 Strilich ..... B65D 75/5855 426/106
2011/0135793 A1 * 6/2011 Maata ..... B65D 77/2024 426/106
2011/0240641 A1 * 10/2011 Huels ..... B29C 66/8491 53/485
2011/0287197 A1 * 11/2011 Britton ..... B29C 49/071 425/149
2012/0067765 A1 * 3/2012 Iseki ..... B29C 65/72 206/524.6
2013/0153577 A1 * 6/2013 Su ..... B65D 81/3453 428/347
2013/0320023 A1 * 12/2013 Chee ..... B65D 81/261 220/571
2014/0001074 A1 * 1/2014 Longo ..... B32B 27/08 206/524.2
2014/0262909 A1 * 9/2014 Gartz ..... B65D 85/36 206/557
2016/0159563 A1 * 6/2016 Bartoli ..... B65B 51/10 53/511
2016/0376071 A1 * 12/2016 Stodd ..... B65D 51/1677 220/359.1
2017/0190451 A1 * 7/2017 van der Vliet ..... B65D 85/8043
2017/0320657 A1 * 11/2017 Parrinello ..... B29C 51/266
2018/0037388 A1 * 2/2018 Vinet ..... B65D 77/204
2019/0099234 A1 * 4/2019 Young ..... B65D 77/2024
2019/0175868 A1 * 6/2019 Spens ..... A61B 50/30
2020/0305637 A1 * 10/2020 Lahti ..... B32B 27/36
2020/0331684 A1 * 10/2020 Ghirardi ..... B65B 7/2878
2020/0346414 A1 * 11/2020 Orchard ..... B65B 7/164
2021/0269222 A1 * 9/2021 Derks ..... B65D 81/264
2021/0308915 A1 * 10/2021 Pucci ..... B29C 66/112

FOREIGN PATENT DOCUMENTS

EP 0344340 A1 * 3/1989 ..... B65B 7/164
EP 0334670 A2 * 12/1989 ..... B29C 66/131
EP 0435638 3/1991
EP 0544429 A1 * 6/1993 ..... B65D 1/34
GB 2219271 A * 12/1989 ..... B29C 37/0082
GB 2471028 A * 12/2010 ..... B65D 1/34
IT 102018000009295 * 10/2018 ..... B29C 43/021
KR 101539187 B1 * 7/2015 ..... B65D 77/2024
WO WO-9604186 A1 * 2/1996 ..... B29C 65/02
WO 2010/018304 A1 2/2010
WO WO-2011120715 A1 * 10/2011 ..... B29C 65/18
WO WO-2012123391 A1 * 9/2012 ..... B29C 51/002
WO WO-2016071685 A1 * 5/2016 ..... B65D 75/322
WO 2016/144308 9/2016
WO WO-2020075059 A1 * 4/2020 ..... B29C 43/021

* cited by examiner

PACKAGING TRAY WITH A PROFILED SEALING EDGE

The invention relates to a packaging tray, produced from a thermoformed plastics sheet, with a base, sidewalls and a sealing edge which is formed peripherally on the upper side of the sidewalls and onto which a sealing film can be placed and can be bonded to the sealing edge.

Various packaging trays of this type are known, to which end reference is made by way of example to WO 2011/120715 A1. They are used in particular to package easily perishable foods, such as meat, or else ready meals, such that they are in a sellable state so that they can be sold to consumers, inter alia, in supermarkets.

When used as food packaging, packaging trays of this type are conventionally provided with a sealing edge which runs around on the upper side and on which, after the packaging tray is filled with the food to be packaged, a sealing film is placed and is bonded or sealed to the sealing edge, and therefore the food is hermetically sealed in the packaging tray and protected against environmental influences.

In order to ensure a reliable and easily producible bonding of the sealing film to the sealing edge, the material or the raw material of the plastics sheet is coordinated with the material or the raw material of the sealing film; ideally, both are based on the same raw material or on raw materials which can readily be sealed to one another, such that a good connection and sealing is obtained by the use of pressure and/or heat.

However, in practice, during the filling of the packaging tray with the food to be packaged, it is unavoidable, in particular at a high packaging speed, that the sealing edge is contaminated during the filling operation, for example by leaking meat juice or ingredients of the inserted ready meal. Such contaminations on the sealing edge subsequently prevent the reliable bonding of the sealing edge in this region to the sealing film placed thereon, and therefore the sealing of the packaged food is not ensured.

It is therefore the object of the invention to propose a packaging tray of the type mentioned at the beginning which, while continuing to have a simple structure, is less susceptible to the unavoidably occurring contaminations of the sealing edge and nevertheless ensures reliable bonding to the sealing film.

In order to achieve the stated object, according to the invention the embodiment of a packaging tray as claimed in the features of patent claim 1 is proposed.

Advantageous embodiments and developments of the invention are the subject matter of the dependent claim.

The proposal according to the invention provides that the sealing edge is formed with a contact surface, which is provided for supporting the sealing film, with a profiling in the form of projections in each case forming part of the contact surface and with depressions which run between adjacent projections and interrupt the contact surface, wherein the depressions in each case define a receiving volume.

It has been shown in practice that the receiving volumes defined by the depressions receive the contaminations possibly adhering to the sealing edge and keep them away from the contact surface while the adjacently arranged projections, which each form part of the contact surface, protrude above the contaminations received in the depressions and ensure reliable bonding of the sealing film, which is placed onto the ribs, in the region of the contact surface. This process is assisted by the fact that, after the sealing film is placed on, a heated sealing or bonding bar conventionally presses onto the sealing film in the region of the contact surface and displaces the contaminations located therebelow and situated on the projections and presses said contaminations into the depressions.

The sealing edge with the profiling provided according to the invention can likewise be formed by corresponding shaping in the thermoforming mold for producing the packaging tray from the plastic sheet provided for this purpose, without an additional working step during the thermoforming operation within the scope of the formation of the packaging tray according to the invention. In this respect, the packaging tray according to the invention can be produced with a comparable outlay to a packaging tray according to the prior art.

The projections can be in the form, for example, of ribs, studs, triangles and other geometric shapes.

According to a proposal of the invention, the depressions are in the form of parallel grooves which run around the sealing edge and between each of which a rib runs. Such grooves are distinguished in a manner known per se by means of a configuration as a fine score in the contact surface of the sealing edge, and they constitute a linear depression with a rounded or flat base in a regular shape. Accordingly, the adjacent ribs also have a regular shape.

In a conventional manner which is known per se, the sealing edge of the packaging tray according to the invention can have a width of approximately 4 to 6 mm, wherein it is provided according to the invention that, as viewed over the width of the sealing edge, there are approximately 10 to 30 depressions, preferably approximately 18 to 20, in particular 19 such depressions.

According to a further proposal of the invention, the depressions, as viewed in cross section, are expanded toward the contact surface, for example at an angle of approximately 60°.

According to a further proposal of the invention, the depressions, as viewed in cross section, are formed in a depth of approximately 0.1 to 0.4 mm and in a width of 0.25 to approximately 0.5 mm, in particular in a depth of 0.2 mm and a width of approximately 0.29 mm in the region of the largest opening in the contact surface.

Furthermore, it can be provided that the plastic sheet and the sealing film are formed on the basis of polyethylene terephthalate, for example on the basis of clear, single-layer (mono) sheets/films. Such packaging trays are produced, for example, from a plastics sheet of a thickness of 300 to 800 μm, wherein the sealing film has a thickness of approximately 20 to 80 μm.

However, a person skilled in the art will recognize that the invention is not restricted to said selection of raw materials. Other plastics sheets and sealing films that are not based on PET may also be used.

Further embodiments and details of the invention will be explained in more detail below with reference to the drawing which illustrates an exemplary embodiment and in which.

Figure 1:
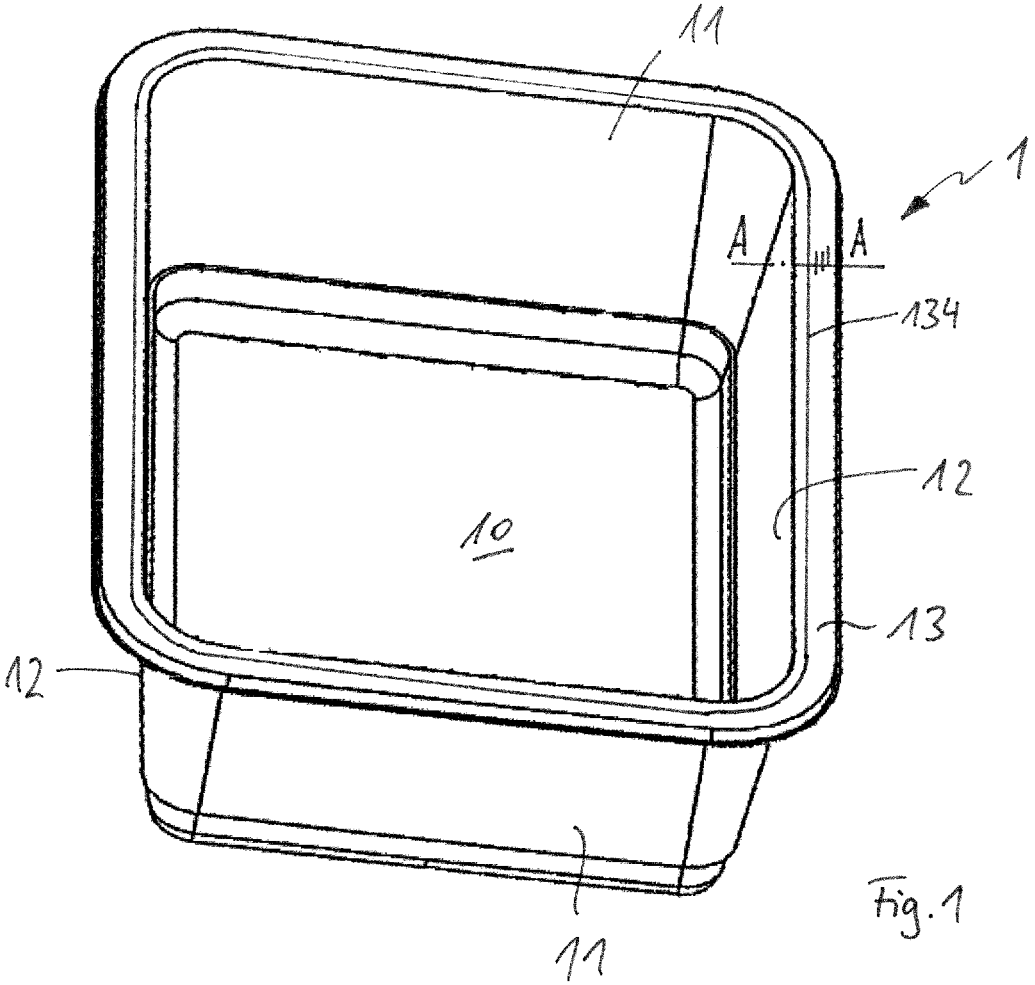
FIG. 1 shows, in a perspective illustration, the top view of a packaging tray according to the invention.
Figure 2:
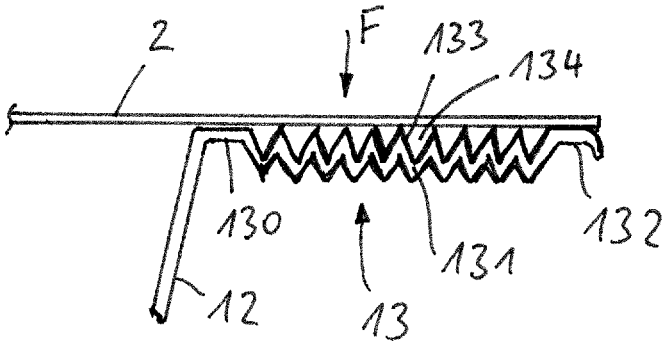
FIG. 2 shows a partial section through the packaging tray according to FIG. 1 along the line A-A.

FIG. 1 shows a packaging tray 1 which, in a manner known per se, has a base 10 and sidewalls 11,12 which are arranged in an encircling manner around the base 10 and continue one another and together bound an upwardly open receiving space in which, for example, a food can be received and packaged. On the upper side of the sidewalls 11,12, the latter end in an encircling sealing edge 13 which extends substantially horizontally and parallel to the base 10 and on which a sealing film 2, which is indicated in FIG. 2, for closing the receiving space can be placed and can be connected along the sealing edge 13 to the latter by bonding. The receiving space within the packaging tray 1 together with the food received therein or other product for packaging is thus hermetically sealed in relation to the surroundings.

Such a packaging tray 1 can be produced, for example, from a single-layer (mono) plastics sheet on the basis of polyethylene terephthalate (PET) of a thickness of 300 to 800 μm by thermoforming in a suitable thermoforming mold. The plastics sheet used may be clear and therefore transparent, or else colored. From the aspect of good bonding capability, the sealing film 2 is also produced from a compatible raw material, preferably the same raw material, for example PET, wherein customary thicknesses of the sealing film used comprise a range of between 20 and 80 μm.

Since, although it is undesirable in practice but nevertheless frequently occurs, that the sealing edge 13 is contaminated during the introduction of the food to be packaged into the receiving space and prior to the bonding to the sealing film, since, for example, liquid drips in regions under the sealing edge 13, problems occur time and again in the bonding of the sealing film 2 since the latter in regions in which the sealing edge 13 is contaminated with liquid does not sufficiently bond to the sealing edge 13 and therefore the hermetic closing of the product being packaged that is located in the receiving space is not ensured.

In order to face this problem, the sealing edge 13 of the illustrated packaging tray 1 is provided with a profiling which can be seen in further details from FIG. 2.

The profiling of the sealing edge 13 is formed by a sequence of adjacent projections 133 which are designed as ribs and between each of which a depression 134 runs. Such an arrangement can easily be produced by corresponding modification of the thermoforming mold used, in the region in which the sealing edge 13 is formed.

FIG. 1 schematically indicates the profile of an individual depression 134. It is seen that said depression runs in a manner corresponding to the profile of the sealing edge 13 fully over the entire extent thereof and continuously, with the further depressions 134 running parallel, which can be seen in FIG. 2, and the ribs 133 which are in each case located in-between and separate the individual depressions 134 from one another, not being illustrated in FIG. 1 for the purpose of better clarity.

However, it is seen from the illustration in FIG. 2 that the sealing edge 13 has a multiplicity of such depressions 134 and ribs 133 in an alternating sequence in which they run parallel to one another and are arranged at a distance becoming greater with respect to the sidewall 12 illustrated here.

Furthermore, it can be seen with reference to the sealing film 2 which is likewise shown and rests smoothly on the sealing edge 13 that the sealing edge 13 has a contact surface, which is provided for supporting the sealing film, in the region of its upper side, said contact surface being interrupted in each case by the depressions 134 while the highest points of the ribs 133 running between the depressions 134 each form part of the contact surface and are in contact with the sealing film 2 and are also bonded thereto.

It has been shown that possible contaminations on the sealing edge 13, in particular in liquid form, do not affect the bonding of the sealing film 2 to the sealing edge 13 since, during the bonding operation, the applied holding-down force, indicated by arrow F, of a bonding bar (not illustrated) causes the contamination possibly located on the sealing edge 13 to be displaced into the depressions 134, in which the contamination consequently accumulates. However, the upper regions of the ribs 133 that each form part of the contact surface then protrude above the contamination in the depressions 134 and can be connected or bonded in the desired manner to the sealing film 2 for sealing purposes. The depressions 134 to this extent form a receiving volume for possible contaminations on the sealing edge 13.

The ribs 133 and depressions 134 in principle can have any desired cross sectional forms, with, however, in respect of an easy production as possible in the thermoforming method, the acute-angled configuration which can be seen in FIG. 2 and in which the individual depressions 134, as viewed in cross section, widen toward the contact surface, for example with an opening angle of approximately 60°, being preferred.

The depressions 134 are formed in this case in the manner of parallel grooves which run around the sealing edge 13 and between each of which a rib 133 is formed. For conventional sealing edge widths of approximately 4 to 6 mm, preferably approximately 10-30 depressions 134 are provided which each, as viewed in cross section, have a depth of 0.1 to 0.4 mm and a width of approximately 0.25 to 0.5 mm. At the deepest point of the depressions 134, a rounding radius of, for example, 0.05 mm can be provided. The maximum width of the ribs running between the depressions 134 can be, for example, approximately 0.3 mm.

However, a person skilled in the art will identify that the dimensions disclosed above merely constitute an exemplary embodiment and differing dimensions may also be provided for the profiling of the sealing edge 13.

The invention claimed is:

1. A packaging tray comprising:

a base (10), sidewalls (11, 12) and a sealing edge (13) which is formed peripherally on an upper side of the sidewalls (11, 12);

the tray produced from a thermoformed single-layer plastic sheet formed of polyethylene terephthalate having a thickness of 300 to 800 μm;

the sealing edge comprising a width, wherein the sealing edge (13) is formed with a profiling in the form of parallel projections which extend around the width of the sealing edge (13), each projection having an apex, wherein the apexes of the projections form a contact surface:

a single-layer sealing film (2) formed of polyethylene terephthalate having a thickness of 20 to 80 μm placed on the sealing edge, welded by heat and pressure to the contact surface of the projections, wherein 10 to 30 depressions (134) are formed between adjacent projections (133) and form interruptions in the welding of sealing film (2) to the sealing edge (13) in a width direction of the tray, wherein the depressions, as viewed in cross section, have a depth of 0.1 to 0.4 mm and a width of 0.25 to 0.5 mm defining a receiving volume between the sealing edge (13) and the sealing film and wherein the depressions (134) are in the form of parallel grooves which run around the width of the sealing edge (13).

2. The packaging tray as claimed in claim 1, wherein the projections (133) are formed by ribs, studs and/or triangles.

3. The packaging tray as claimed in claim 1, wherein between each parallel groove is a projection (133) in the form of a rib runs.

4. The packaging tray as claimed in claim 1, wherein the sealing edge (13) has a width of 4 to 6 mm.

5. The packaging tray as claimed in claim 1, wherein the depressions (134), as viewed in cross section, widen toward the contact surface.

* * * * *